US006082921A

United States Patent [19]

Caldwell

[11] Patent Number: 6,082,921

[45] **Date of Patent: *Jul. 4, 2000**

[54] SELF-CLEANING PAINT BRUSH WITH IMPROVED PLUG

[75] Inventor: Donald L. Caldwell, San Diego, Calif.

[73] Assignee: Caldwell Industries, Inc., San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/093,068

[22] Filed: Jun. 8, 1998

[51] Int. Cl.[7] ..... A46B 11/00

[52] U.S. Cl. ..... 401/287; 401/282; 15/205.2

[58] Field of Search ..... 401/268, 282, 401/285–288; 15/205.2, 159.1

[56] References Cited

U.S. PATENT DOCUMENTS

| | | | |
|---|---|---|---|
| 1,928,929 | 10/1933 | Craig | 401/286 |
| 2,512,997 | 6/1950 | Bixler | 15/159.1 |
| 4,916,773 | 4/1990 | McCoy | 401/268 |
| 5,483,721 | 1/1996 | Caldwell | 401/282 |
| 5,483,723 | 1/1996 | Wenzer | 15/159.1 |

FOREIGN PATENT DOCUMENTS

| | | | |
|---|---|---|---|
| 247857 | 1/1961 | Australia | 401/268 |
| 37327 | 4/1969 | Finland | 401/268 |

*Primary Examiner*—Charles R. Eloshway
*Attorney, Agent, or Firm*—Harrison & Egbert

[57] ABSTRACT

An improved paint brush having a body, a handle connected to and extending outwardly from the body, a plurality of bristles extending outwardly from the body, and a plug affixed to the body within the plurality of bristles. The plug has a bar and a plurality of tubular members extending from the bar. The bar is a planar member with an edge extending transverse to a longitudinal axis of the handle. The plurality of tubular members includes a first plurality of tubular members arranged on one side of the bar and a second plurality of tubular members arranged on an opposite side of the bar. Each of the first and second pluralities of tubular members has a top opening and a bottom opening. The bottom opening is adjacent to the bar. The top opening communicates with a plenum area formed on the interior of the body. The bar and the plurality of tubular members are integrally formed together of a polymeric material.

14 Claims, 2 Drawing Sheets

SELF-CLEANING PAINT BRUSH WITH IMPROVED PLUG

TECHNICAL FIELD

The present invention relates to paint brushes. More particularly, the present invention relates to self-cleaning paint brushes whereby the paint on the bristles can be flushed and cleaned. Furthermore, the present invention relates to plugs as used with paint brushes in the area of the connection between the bristles of the paint brush and the body of the paint brush.

BACKGROUND ART

Paint brushes are widely known for the painting of surfaces and objects. Typically, a paint brush is used by placing the bristles of the paint brush into a container of paint. After the painting activity has been completed, it is necessary to clean the bristles of the paint brush. Often, the bristles are cleaned by inserting the bristles into a bucket of cleaning fluid or water. The cleaning of the paint brush is often a time consuming and tedious activity. Many times, the bristles are never cleaned to the satisfaction of the owner of the paint brush. Additionally, when the paint brush is placed into a bucket, only the outer surfaces of the bristles have direct contact with the water. The water, or other cleaning liquid, in the bucket, does not effectively penetrate or circulate throughout the bristles so as to maximize the ability to clean the bristles.

In the past, brushes of various types have utilized fluid connecting passages so as to enable paint to be directed through the brushes for various purposes. These prior art paint brushes have failed to utilize and orient such passages for receiving a water hose to enable the cleaning of the paint brush subsequent to its use in a painting operation.

U.S. Pat. No. 1,928,929, issued on Oct. 3, 1933 to C. F. Ceraig teaches a paint brush having a removable handle. When the handle is unscrewed from the body of the paint brush, an opening is provided so as to allow liquid to be inserted through orifices formed adjacent to the bristles. In this arrangement, cleaning fluid is forced through channels in areas adjacent to an end of the bristles.

U.S. Pat. No. 2,126,199, issued on Aug. 16,1938, to H. F. Mitchell teaches a paint brush in which paint can be fed, under pressure, through the handle of the brush, through a longitudinal channel, and into an area amongst the bristles extending outwardly from the body.

U.S. Pat. No. 2,806,236, to Stefano sets forth a rotary painting brush wherein a hose arrangement is formed through a rear handle portion of the paint brush to provide both rotary movement and impart fluid to the bristles of the paint brush to effect a painting operation.

U.S. Pat. No. 3,509,872, to Stillman sets forth a dental cleansing and massaging apparatus wherein fluid is directed orthogonally into an elongate body of the device to effect a rotary operation of the various tools utilized at opposite ends of the body member.

U.S. Pat. No. 3,603,694, issued on Sep. 7, 1971, to R. D. Hamm describes a pistol-type handle on the end of a hollow hub affixed to the bristles of a paint brush. A trigger-actuated mechanism is provided so as to pump paint between the bristles of the paint brush. The handle and the pumping device are connected by a flexible hose to a portable paint container.

U.S. Pat. No. 4,175,300 to McGlew et al. sets forth a paint roller construction wherein paint is directed through the elongate handle and body portion of the roller, and directed through the roller so as to direct paint through the roller and onto a surface to be painted.

U.S. Pat. No. 4,660,244 to Poliak sets forth a hydraulic tooth and gum cleaning device utilizing liquid jets to supply a rotary motion to the tool and direct such fluid onto associated teeth and gums.

U.S. Pat. No. 4,676,685, issued on Jun. 30,1987, to E. P. Murphy describes a power brush coating applicator having a separable handle, a valved housing and a brush housing. The handle of the applicator is adapted for connection to a source of pressurized liquid. An interior flow path is provided through the valve chamber and into flow communication with the capillary openings adjacent to the bristles.

International Publication No. WO 88/0734, published on Oct. 6, 1988, to Varrichione provides a detachable manifold and brush assembly having a bristle head with a detachable manifold having a feed port. A distribution channel communicates with the feed port. Feed conduits are provided so as to distribute paint to the bristles. The bristle heads and the manifold are removably secured together.

U.S. Pat. No. 5,483,721, issued on Jan. 16, 1996, to the present inventor describes a self-cleaning paint brush. This self-cleaning paint brush includes a body, a handle connected to and extending outwardly from the body, a plurality of bristles arranged in a plurality of rows and extending outwardly from the body, a liquid inlet channel formed so as to extend through the body toward the plurality of bristles, and a plenum area formed in the body and connected to the liquid inlet channel. The plenum area has a plurality of outlet orifices formed therein adjacent to an end of the plurality of bristles. These outlet orifices are arranged in rows between the plurality of bristles. An adapter member is slidably received within the liquid inlet channel. As liquid is introduced through the liquid inlet channel, it passes to the plenum area and eventually passes onto and through the plurality of bristles.

Experiments with the self-cleaning paint brush of U.S. Pat. No. 5,483,721 have indicated that an improved plug for the paint brush can be achieved. The existing bar, which is placed so as to extend as a planar member centrally throughout the plurality of bristles, achieves certain good effects in terms of the distribution of fluid throughout the bristles. However, experiments have found that the distribution of cleaning fluid throughout the bristles can be improved by changing the plug of this paint brush. Furthermore, certain benefits in terms of paint application maximization and brush filament minimization could also be achieved by changing the plug design of the self-cleaning paint brush of U.S. Pat. No. 5,483,721.

It is an object of the present invention to provide a paint brush that can be easily and thoroughly cleaned during a painting operation.

It is another object of the present invention to provide a self-cleaning paint brush that allows the cleaning liquid to be evenly distributed throughout the bristles.

It is a further object of the present invention to provide a self-cleaning paint brush in which the source of liquid can be disconnected as required.

It is still a further object of the present invention to provide a self-cleaning paint brush which is easy to use, easy to manufacture, and relatively inexpensive.

It is another object of the present invention to provide a self-cleaning paint brush that minimizes the amount of water required for cleaning the brush.

It is another object of the present invention to provide a self-cleaning paint brush that increases the life of the brush.

It is a further object of the present invention to provide a self-cleaning paint brush that reduces the cost of brushes to painters.

It is another object of the present invention to provide a self-cleaning paint brush that reduces labor costs.

It is another object of the present invention to provide a self-cleaning paint brush that reduces waste and minimizes disposal problems.

It is another object of the present invention to provide a plug for a self-cleaning paint brush which facilitates cleaning fluid distribution throughout the bristles.

It is still another object of the present invention to provide a plug for a self-cleaning paint brush which minimizes the number of filaments required for the maximum application of paint relative to the amount of paint pickup.

It is still a further object of the present invention to provide an improved plug for a self-cleaning paint brush which minimizes the weight of the paint brush.

These and other objects and advantages of the present invention will become apparent from a reading of the attached specification and appended claims.

SUMMARY OF THE INVENTION

The present invention is an improved paint brush assembly which utilizes an improved plug. This improved paint brush assembly includes a body, a handle connected to and extending outwardly from the body, a plurality of bristles extending outwardly from the body, and the improved plug. The improved plug is affixed to the body within the plurality of bristles. The plug has a bar and a plurality of tubular members extending from the bar.

The bar is a planar member having an edge extending transverse to a longitudinal axis of the handle. The plurality of tubular members includes a first plurality of tubular members arranged on one side of the bar and a second plurality of tubular members arranged on an opposite side of the bar. The bar has a top edge and a bottom edge. Each of the first plurality of tubular members has a longitudinal axis parallel to a surface of the bar. Each of the second plurality of tubular members has a longitudinal axis in parallel relationship to a surface of the bar. Each of the plurality of tubular members has a top opening and a bottom opening. The bottom opening is adjacent to the bar. The first plurality of tubular members are in parallel relationship with the second plurality of tubular members. The plurality of tubular members extends within the plurality of bristles so as to form a plurality of pockets adjacent to the bottom opening.

The body has a plenum area formed therein. The top opening of the first and second pluralities of tubular members communicates with the plenum area. The body has a liquid inlet channel formed therein so as to extend through the body to the plenum area. An adapter member is slidably and removably received within the liquid inlet channel. The liquid inlet channel extends at an acute angle relative to a longitudinal axis of the handle.

The improved plug of the present invention includes the bar and the plurality of tubular members which are integrally formed together of a polymeric material.

DETAILED DESCRIPTION OF THE INVENTION

Figure 1:
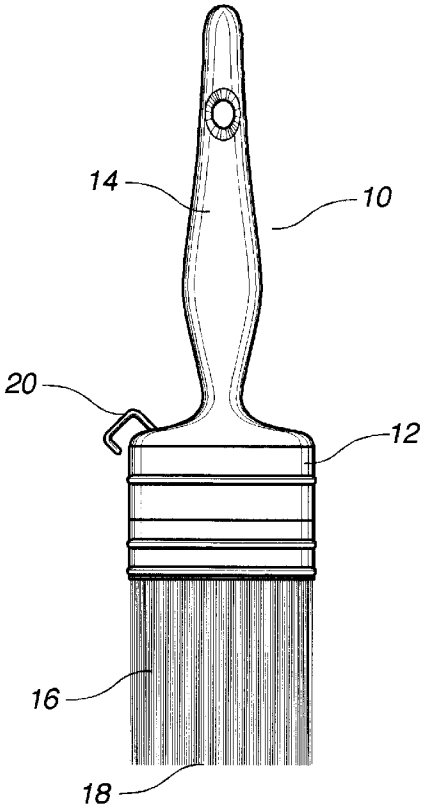
FIG. 1 is a front elevational view of the paint brush in accordance with the present invention.

Referring to FIG. 1, there is shown at 10 the self-cleaning paint brush in accordance with the present invention. The paint brush 10 includes a body 12 having a handle 14 extending outwardly therefrom. A plurality of bristles 16 are arranged in a plurality of rows and extend outwardly from the body 12. As can be seen in FIG. 1, the paint brush 10 resembles a conventional paint brush.

Specifically, in FIG. 1, it can be seen that the handle 14 is nonremovably connected to, or integrally formed with, the body 12. The combination of the body 12 and the handle 14 defines a longitudinal axis extending through the paint brush 10. The bristles 16 extend outwardly from the end of the body 12 so as to form an end surface 18 suitable for the receipt of paint thereon.

In FIG. 1, it can be seen that a clip 20 is affixed to an exterior surface of the body 12 and extends outwardly therefrom. This clip 20 is a spring-type of clip for detachably securing the body 12 to an edge of a paint bucket. Various configurations of clip 20 can be used within the scope of the present invention. It is intended that the clip 20 be attached to the body 12 so as to allow the paint brush 10 to be supported within a paint bucket.

Figure 2:
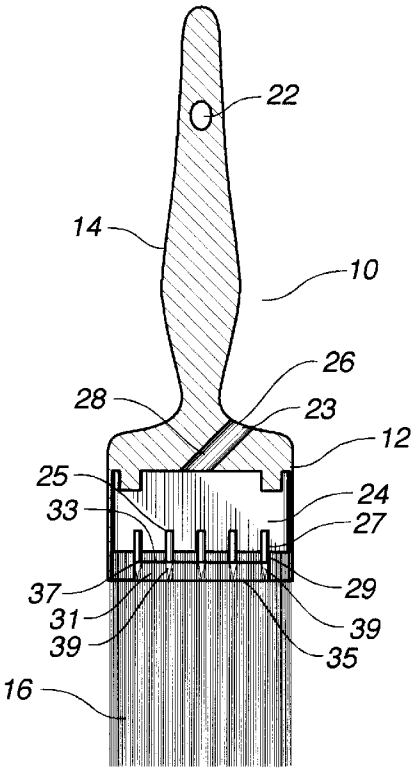
FIG. 2 is a cross-sectional view of the paint brush of the present invention showing the improved plug.

As seen in FIG. 2, the improved paint brush of the present invention includes handle 14, body 12, and bristles 16. As can be see in FIG. 2, the handle 14 is a solid member that is integrally formed with the body 12. A hole 22 is formed at the end of handle 14 so as to allow the handle 14 to be properly hung on a hook or other support. A liquid inlet channel 23 is formed in the body 12 so as to extend through the body 12 toward the plurality of bristles 16. A plenum area 24 is formed in the body 12 and is connected to the liquid inlet channel 22. As will be described hereinafter, the plenum area 24 includes the top openings 25 of the tubular members 27 as used with the improved plug member 29 of the present invention.

As can be seen in FIG. 2, the liquid inlet channel 23 is located away from the handle 14. This allows the paint brush 10 to be utilized in the manner of a conventional paint brush, when cleaning is not required. There is no need to unscrew the handle, or to otherwise manipulate the handle for the purposes of cleaning activity. Since a large amount of force is applied to the handle 14 during painting activities, it has been determined that it is wise not to sacrifice the integrity of the handle 14 for the inclusion of a liquid inlet channel. Additionally, the shorter the length of the inlet channel 23, the easier it is to "pump in" large amounts of cleaning fluid.

It can be seen that the plurality of bristles 16 are affixed to the body 12 adjacent to the plenum area 24. The liquid inlet channel 23 has one end 26 opening along the exterior surface of the body 12. The liquid inlet channel 23 has another end 28 which opens to the plenum area 24. The liquid inlet channel 23 is configured so as to extend at an acute angle relative to the longitudinal axis of the handle 14. The novel use of this acute angle arrangement allows the liquid inlet channel 23 to be conveniently connected to a water outlet, such as a faucet or hose. The use of the inlet channel 23, in the configuration shown in FIG. 2, also allows the paint brush to assume its "self-cleaning" mode without the need for attachment to a water outlet. After experimentation, it has been found that the paint brush 10 of the present invention can be effectively cleaned by simply dipping the paint brush into a bucket of water. Whenever the paint brush 10 is dipped into a bucket of water, the water will flow into the inlet channel 23 and into the plenum area 24. As a result, water will flow through the tubular members 25 of the improved plug 29 so as to effectively clean the plurality of bristles 16. While this is occurring, the dipping of the paint brush into the bucket of water will also clean the remaining portions of the bristles 16. The cleaning of the bristles 16 adjacent to the plenum area 24 effectively eliminates the buildup of paint in the bristles at the base of the body 12 of the brush. The configuration of the present invention effectively cleans the entire length of the bristles 16.

Importantly, in FIG. 2, it can be seen that the improved plug 29 includes a bar 31 which extends in transverse relationship to the longitudinal axis of the handle 14. The bar 31 is a planar member with a top edge 33 and a bottom edge 35. The tubular members 27 have a bottom opening 37 which is adjacent to a side of the bar member 31. The top opening 25 of the plurality of tubular members 27 opens into the plenum area 24. As can be seen, the ends of the bristles 16 extend through and around the tubular members 27 and the bar 31. The specific configuration of this improved plug will be shown in greater detail in connection with FIGS. 5–7.

Importantly, in FIG. 2, it can be seen that a plurality of pockets 39 are formed at the bottom opening 29 of the plurality of tubular members 27. These pockets 39 represent pockets formed in the ends of the plurality of bristles 16 adjacent to the improved plug of the present invention. These pockets enhance the distribution of any cleaning liquid throughout and through the plurality of bristles 16. Additionally, these pockets result in the use of ten to twelve percent less bristle filament than would be used in paint brushes with conventional plugs. The cost of the bristles is significant in the overall cost of the brush. The tubular members 27 enhance the flow of the cleaning fluid from the plenum area 24 into and through the bristles 16. Additionally, as will be described hereinafter, experiments with the paint brush of the present invention have shown that, with the use of the improved plug of the present invention, the paint pickup and laydown is greater than with competitive paint brushes. Furthermore, the use of the plug of the present invention reduces the weight of the paint brush.

Figure 3:
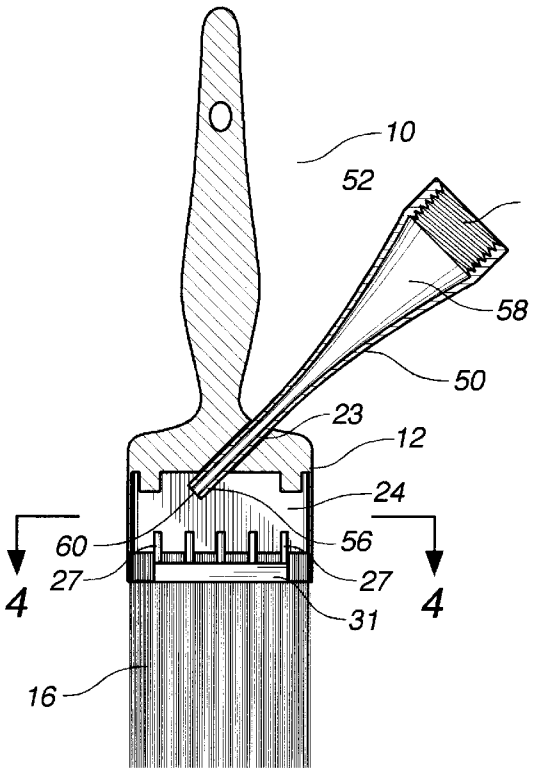
FIG. 3 is a cross-sectional view of the present invention showing the use of an adapter member for the introduction of fluid into the plenum area of the paint brush.

FIG. 3 shows the use of an adapter member 50 as utilized in conjunction with the self-cleaning paint brush 10 of the present invention. As can be seen, the adapter member 50 has its insert end 56 slidably received within the inlet channel 23. The outlet 60 of the adapter member 50 is positioned within the plenum area 24 of the body 12 of the paint brush 10. When the connector end 52 is attached to a garden hose (or faucet), water is pumped into the interior 58 and outwardly through the outlet 60. This serves to fill the plenum area 24 with the cleaning liquid. As pressure is built up within the plenum area 24, the cleaning liquid will pass outwardly through the tubular members 27 adjacent to the bristles 16. After the bristles have been properly cleaned, then the adapter member 50 can be slidably removed from the liquid inlet channel 23. Any excess liquids found in the plenum area 24 can be easily emptied through the tubular members 27 or through the liquid inlet channel 23.

The configuration of the present invention allows the paint brush 10 to be utilized as a conventional paint brush. However, when it is necessary to clean the brush 10, the configuration of the adapter member 50 and the inlet channel 22 allows water to be introduced into, around, and throughout the plurality of bristles 16. As such, the self-cleaning paint brush 10 of the present invention can effectively remove paint from all of the surfaces of the bristles 16.

Figure 4:
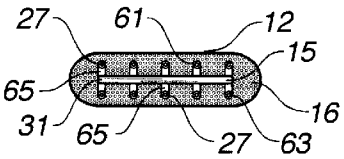
FIG. 4 is a cross-sectional view taken across lines 4—4 of FIG. 3 showing the improved plug as used with the paint brush of the present invention.

FIG. 4 shows the plug member 15 as utilized within the body 12 of the paint brush 10 of the present invention. In FIG. 4, it can be seen that the bar 31 extends centrally between the plurality of tubular members 27. As can be seen, a first plurality of tubular members 61 is formed on one side of the bar 31. A second plurality of tubular members 63 is formed on the opposite side of the bar 31. Bridging members 65 extend between the respective tubular members and the bar 31. The first plurality of tubular members 61 totals five tubular members 27. The second plurality of tubular members 73 totals five tubular members 27. Each of the tubular members 27 is arranged so as to have a longitudinal axis in parallel relationship with a surface of the bar 31. It can be seen that the first set of tubular members 61 is arranged, respectively, in corresponding location on the opposite side of the bar 31 from the second plurality of tubular members 63. It can be seen that the plurality of bristles 16 extends around the tubular members 27 and around the bar 31.

Figure 5:
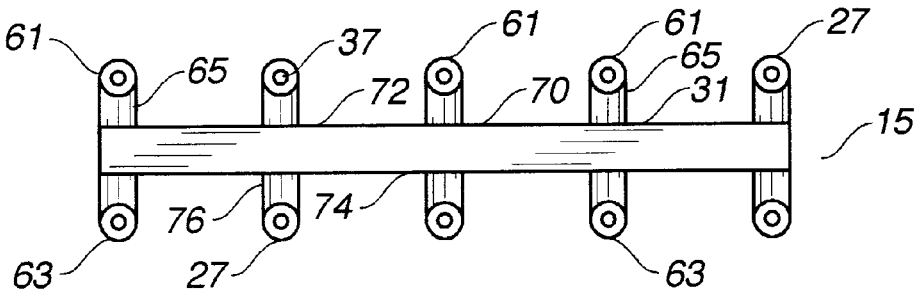
FIG. 5 is a bottom view of the improved plug of the present invention.

Referring to FIG. 5, there is shown at 15 the improved plug in accordance with the teachings of the present invention. The improved plug includes a bar 31 and a plurality of tubular members 27 that extend outwardly from the bar 31. The bar 31 has an edge 70 which extends transverse to the longitudinal axis of the handle 14 of the paint brush 10. The bar 31 extends for the length of the plug 15. The tubular members 27 have a bottom opening 37 and an interior passageway which extends throughout the length of the tubular members 27.

The plurality of tubular members includes a first plurality of tubular members 61 and a second plurality of tubular members 63 arranged on opposite sides of the bar 31. Each of the first plurality of tubular members 61 has a longitudinal axis which is parallel to a surface 72 of the bar 31. Each of the second plurality of tubular members 63 has a longitudinal axis in parallel relationship to a surface 74 of the bar 31. It can be seen that the bar 31 is a generally planar member which extends between the first plurality of tubular members 61 and the second plurality of tubular members 63. As can be seen, a plurality of bridge members 65 extend, respectively, between the side 72 of the bar 31 and each of the first plurality of tubular members 61. Similarly, bridge members 76 extend between the side 74 of the bar 31 and each of the plurality of tubular members 63. As can be seen, the first plurality of tubular members 61 totals five tubular members in number. The second plurality of tubular members 63 totals five tubular members in number. Each of the tubular members is evenly spaced from an adjacent tubular member. The first set of tubular members 61 is arranged, respectively, in corresponding location to the second set of tubular members 63 on opposite sides of the bar 31.

Figure 6:
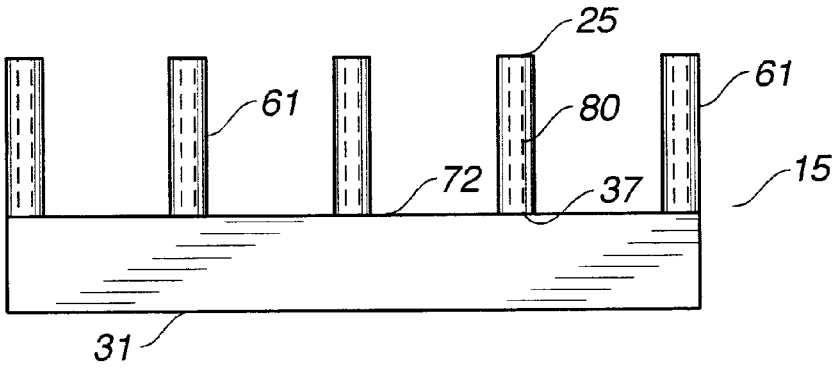
FIG. 6 is an isolated side elevational view in partial cross section showing the improved plug of the present invention.

FIG. 6 shows the plug member 15 as having the bar 31 located below the first plurality of tubular members 61. As can be seen, the tubular members 61 have a top opening 25 and a bottom opening 37. A fluid passageway 80 extends within each of the tubular members 61 from the top opening 25 to the bottom opening 37. The bottom opening 37 opens adjacent to a side 72 of the bar 31. Each of the tubular members 61 has a longitudinal axis in parallel relationship to an adjacent tubular member. Each of the tubular members 61 is in evenly spaced relationship from an adjacent tubular member.

Figure 7:
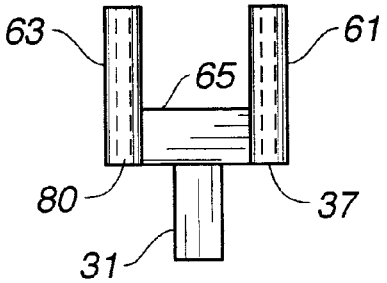
FIG. 7 is an end view in partial cross section of the improved plug of the present invention.

FIG. 7 shows the end view of the plug member 15. As can be seen in this end view, the first plurality of tubular members 61 is in generally parallel and corresponding location to the second plurality of tubular members 63. The bar 31 is positioned generally centrally between the first plurality of tubular members 61 and the second plurality of tubular members 63. The bottom opening 37 of the first plurality of tubular members 61 and the bottom opening 80 of the second plurality of tubular members 63 opens on opposite sides of the bar 31. Each of the tubular members 61 and 63 will form a "pocket" adjacent to the respective bottom openings 37 and 80. This pocket minimizes the number of filaments required for the paint brush and also "enhances" the paint pickup and paint laydown.

Experiments were conducted with the present invention relative to existing paint brushes on the market. Table 1, as follows, summarizes these results:

TABLE 1

BRUSH TEST DATA

| Brush | Filament Length | Weight | Paint Pickup | Paint Laydown |
|---|---|---|---|---|
| Purdy XL Bow | 3¼" | 2139 g | 27 g | 3 g |
| MBC Salem | 3⅛" | 2151 g | 21 g | 4 g |
| EasyClean | 3¼" | 2090 g | 27 g | 5 g |
| Purdy XL Sprig | 3¼" | 2124 g | 26 g | 4 g |

As can be seen from the attached table, the present invention is identified as the "EasyClean" (TM) paint brush. This paint brush has a paint laydown of 5 grams as opposed to the paint laydown of equivalently sized paint brushes. Despite greater paint pickup and laydown, the paint brush of the present invention has lesser weight than the other brushes.

In general, it has been found that the area displaced through the use of the tubular members and the bar reduces the number, the cost and the weight of filaments that are required for the complete paint brush. Furthermore, formation of "pockets" optimizes the spacing of the bristles so as to maximize the amount of paint pickup and laydown. Configuration of the present invention, in particular, enhances the ability to "self-clean" the paint brush. The improved plug of the present invention is of minimal weight. Since the plug of the present invention is integrally formed of a polymeric material, each of the plugs of the present invention can be manufactured for pennies. As such, the present invention offers a significant improvement over prior paint brushes that simply use a simple planar wooden plug.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An improved paint brush comprising:

a body;

a handle connected to and extending from said body;

a plurality of bristles extending outwardly from said body, each of said plurality of bristles having an end affixed to said body and a length dimension extending therefrom; and a plug affixed to said body and extending into said plurality of bristles, said plug having a bar and a plurality of tubular members extending from said bar, each tubular member being spaced and separate from an adjacent tubular member, said plurality of tubular members defining bristle-free pockets within said plurality of bristles, said bar being a planar member which is co-planar with said body and said handle and having an edge extending transverse to a longitudinal axis of said handle, said plurality of tubular members each having an exterior surface surrounded by said plurality of bristles, said plurality of tubular members extending from said end of said plurality of bristles along at least a portion of said length dimension of said plurality of bristles, said plurality of tubular members comprising;

a first plurality of tubular members arranged one one side of said bar; and a second plurality of tubular members arranged on an opposite side of said bar.

2. The improved paint brush of claim 1, said bar having a top edge and a bottom edge, each of said first plurality of tubular members having a longitudinal axis parallel to a surface of said bar, each of said second plurality of tubular members having a longitudinal axis in parallel relationship to said surface of said bar.

3. The improved paint brush of claim 1, each of said plurality of tubular members having a top opening and a bottom opening, said bottom opening being adjacent to said bar.

4. The improved paint brush of claim 3, said body having a plenum area formed therein, said top opening of said plurality of tubular members communicating with said plenum area.

5. The improved paint brush of claim 4, said body having a liquid inlet channel formed therein so as to extend through said body to said plenum area.

6. The improved paint brush of claim 5, further comprising:

an adapter member slidably and removably received within said liquid inlet channel.

7. The improved paint brush of claim 5, said liquid inlet channel extending at an acute angle relative to a longitudinal axis of said handle.

8. The improved paint brush of claim 1, each of said first plurality of tubular members having a longitudinal axis in parallel relationship with each of said second plurality of tubular members.

9. The improved paint brush of claim 1, said first plurality of tubular members being five tubular members, said second plurality of tubular members being five tubular members, said five tubular members of said first plurality being arranged respectively so as to correspond in position to said five tubular members of said second plurality on opposite sides of said bar, each of the tubular members of said first plurality being evenly spaced from an adjacent tubular member, each of the tubular members of said second plurality being evenly spaced from an adjacent tubular member of said second plurality.

10. A plug for a paint brush comprising:

a generally planar bar;

a first plurality of tubular members arranged on one side of said bar, each of said first plurality of tubular members being spaced and separate from an adjacent tubular member of said first plurality of tubular members;

a second plurality of tubular members arranged on an opposite side of said bar, each of said second plurality of tubular members being spaced and separate from an adjacent tubular member of said second plurality of tubular members;

a plurality of bridge members extending respectively from said bar to said first and second pluralities of tubular members such that each of said first and second pluralities of tubular members has a longitudinal axis in parallel relation to a surface of said bar.

11. The plug of claim 10, each of said plurality of tubular members having a top opening and a bottom opening, said bottom opening being adjacent to said bar.

12. The plug of claim 10, each of said first plurality of tubular members having a longitudinal axis in parallel relationship with each of said second plurality of tubular members.

13. The plug of claim 10, said first plurality of tubular members being five tubular members evenly spaced from each other, said second plurality of tubular members being five tubular members evenly spaced from each other, said five tubular members of said first plurality being respectfully arranged corresponding in position to said five tubular members of said second plurality on opposite sides of said bar.

14. The plug of claim 10, said bar and said plurality of tubular members being integrally formed together of a polymeric material.

* * * * *